US005865670A

United States Patent [19]

Frank et al.

[11] Patent Number: 5,865,670

[45] Date of Patent: Feb. 2, 1999

[54] WAFER DEMOUNT APPARATUS

[75] Inventors: Kenneth Abraham Frank, St. Charles; Roger Paul Durkee, St. Peters; Francis Richard Bronson, High Ridge; Richard William Heim, St. Peters, all of Mo.

[73] Assignee: MEMC Electronic Materials, Inc., St. Peters, Mo.

[21] Appl. No.: 941,777

[22] Filed: Sep. 30, 1997

[51] Int. Cl.[6] ..... B24B 41/06

[52] U.S. Cl. ..... 451/339; 451/331; 414/937

[58] Field of Search ..... 451/331, 339; 414/937, 416

[56] References Cited

U.S. PATENT DOCUMENTS 4,944,119 7/1990 Gill, Jr. et al. ..... 451/331

5,095,661 3/1992 Gill, Jr. et al. ..... 451/331

OTHER PUBLICATIONS

"Wafer Demount Station", 1 page, no date.

*Primary Examiner*—David A. Scherbel
*Assistant Examiner*—Shantese McDonald
*Attorney, Agent, or Firm*—Senniger, Powers, Leavitt & Roedel

[57] ABSTRACT

Wafer demount apparatus automatically demounts and transports a polished semiconductor wafer to an inspection station. The apparatus includes a bridge located between a polishing block supporting wax-mounted wafers and an offload conveyor. The bridge fills the gap and provides a smooth transition surface for the wafers moving from the polishing block to the conveyor. The bridge is also capable of movement to achieve vertical and horizontal alignment with the polishing block.

20 Claims, 5 Drawing Sheets

WAFER DEMOUNT APPARATUS

BACKGROUND OF THE INVENTION

This invention relates generally to wafer demount apparatus and more specifically to wafer demount apparatus having a bridge to protect demounted articles from damage.

Polishing an article to produce a surface which is highly reflective and damage free has application in many fields. A particularly good finish is required when processing an article such as a wafer of semiconductor material in preparation for printing circuits on the wafer by an electron beam-lithographic or photolithographic process. In one well known process for semiconductor wafers, multiple wafers are wax mounted onto a polishing block. The polishing block is placed face down onto a polishing pad so that polish faces of the wafers engage the polish pad. The pad and the polishing block are rotated as a large normal force is applied to the polishing block forcing it down into engagement with the pad. A polishing slurry, typically including chemical polishing agents and abrasive particles, is applied to the pad. Multiple polishing sequences may be carried out to reach the desired final finish of the wafers.

Once polishing is complete the wafers must be removed from the polishing block and inspected for faults. Presently, the polishing blocks are transported, face up, to a demount station where a wedge-shaped prying tool is activated to break the wax bond and detach the wafer from the polishing block. A conveyor is disposed adjacent to the polishing block at the demount station. The prying tool pushes the wafer after it is released from the polishing block onto the conveyor for transport to the inspection station.

It has been found that the wafers fly upward a short distance off of the polishing block and away from the prying tool upon their release from the wax. Thus, the wafer is not controlled for a brief period of time. There is a gap between the edge of the polishing block and the conveyor which is substantially smaller than the diameter of the wafer. Frequently, a leading edge of the wafer flies into the gap so that when the wafer falls back down against the polishing block, the back side of the wafer hits the edge of the block, leaving a mark on the back side of the wafer. It was also possible for the leading edge of the wafer to strike a pulley of the conveyor, causing damage.

SUMMARY OF THE INVENTION

Among the several objects and features of the present invention may be noted the provision of a wafer demount apparatus including a bridge which protects semiconductor wafers from damage on their back sides when demounted from a polishing block; the provision of such apparatus which permits self alignment of the bridge with the polishing block for establishing a smooth continuous surface from the polishing block to a conveyor; the provision of such apparatus which transfers wafers smoothly from the bridge to the conveyor; the provision of such apparatus which prevents the wafer from impacting the pulleys of the conveyor; the provision of such apparatus in which the bridge does not interfere with vertical movement of the polishing block; and the provision of such apparatus which maintains throughput to an inspection device for the wafers.

Wafer demount apparatus constructed according to the principles of the present invention is used for removal of a semiconductor wafer adhered to a polishing block having a top surface on which the wafer is adhered and a peripheral edge. Generally, the apparatus comprises a support for holding the polishing block with the wafer adhered thereto in an orientation with the wafer facing upwardly. A wafer demount mechanism is capable of detaching the wafer from the polishing block. An offload conveyor positioned with respect to the wafer demount mechanism to receive the wafer after demounting by the demount mechanism transports the wafer away from the polishing block. The offload conveyor is spaced from the support such that the nearest edge of the polishing block is spaced from the conveyor when disposed on the support to define a gap between the polishing block and conveyor. A bridge has an abutment face of a shape complementary to that of the polishing block edge and disposed for receiving the polishing block into engagement with the bridge. The bridge is located intermediate the support and offload conveyor and bridges the gap between the polishing block when held on the support and the offload conveyor whereby the wafer is transferred from the polishing block to the conveyor without damage to the wafer when demounted from the polishing block by the wafer demount mechanism.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
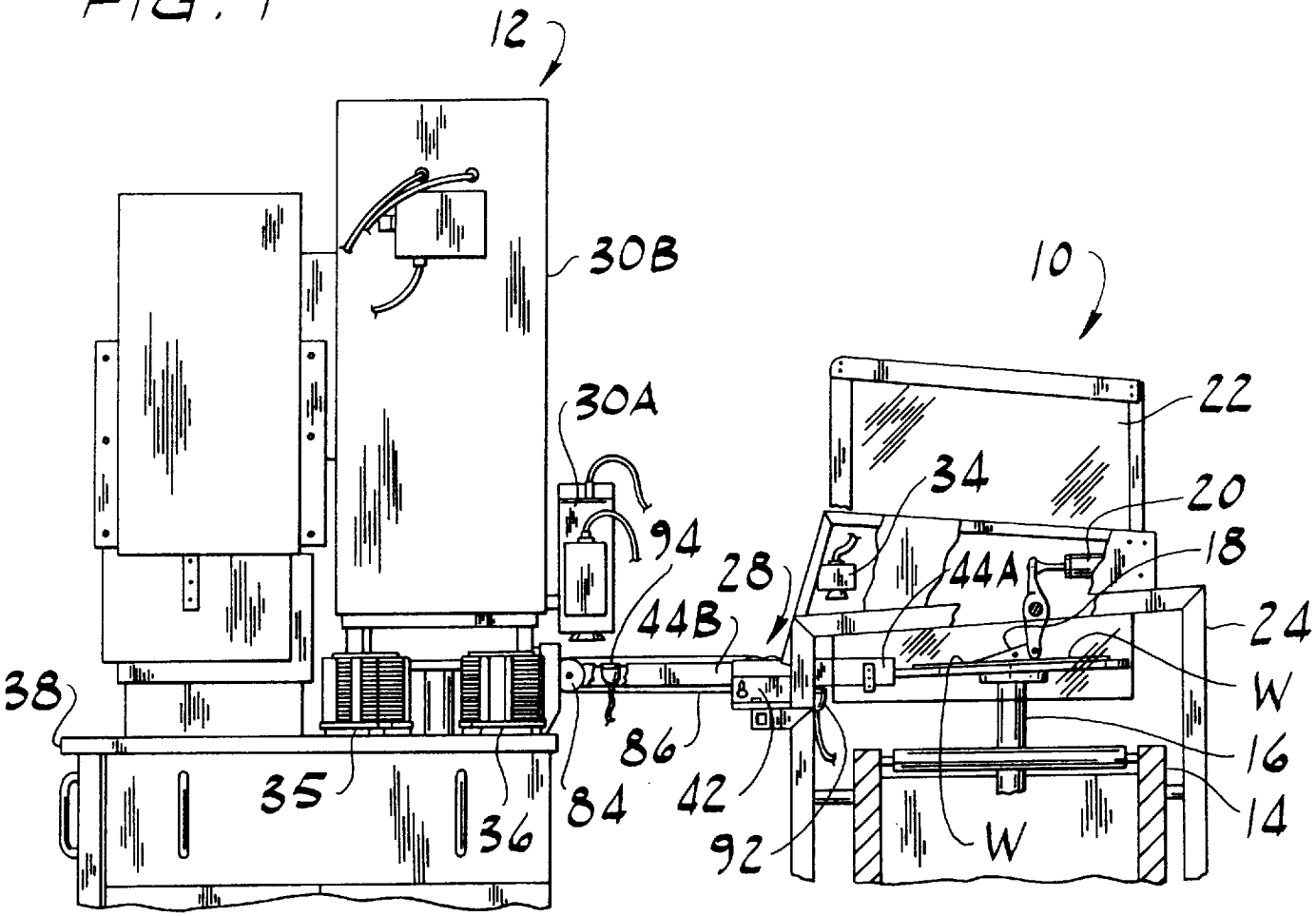
FIG. 1 is a schematic side elevational view of wafer demount apparatus with parts broken away to show internal construction.

Referring now to the drawings, and in particular to FIG. 1, wafer demount apparatus and wafer inspection and loading apparatus are indicated generally by respective reference numerals 10 and 12. A block conveyor 14 carries polishing blocks B having polished semiconductor wafers W wax mounted thereon from a polishing apparatus (not shown) to the wafer demount apparatus 10. The wafer demount apparatus 10 includes a support 16 which is movable between a lowered position generally flush with the block conveyor 14 for receiving the polishing block B, and a raised position shown in FIG. 1. In the raised position, the polishing block B is disposed for removal of the wafers W by a wedge-shaped prying tool 18 actuated by a pneumatic cylinder 20 (broadly, "a wafer demount mechanism") to pry one wafer at a time from the polishing block. The prying tool 18 and support 16 are substantially enclosed by a transparent housing 22 supported on a frame 24 of the wafer demount apparatus 10.

Figure 2:
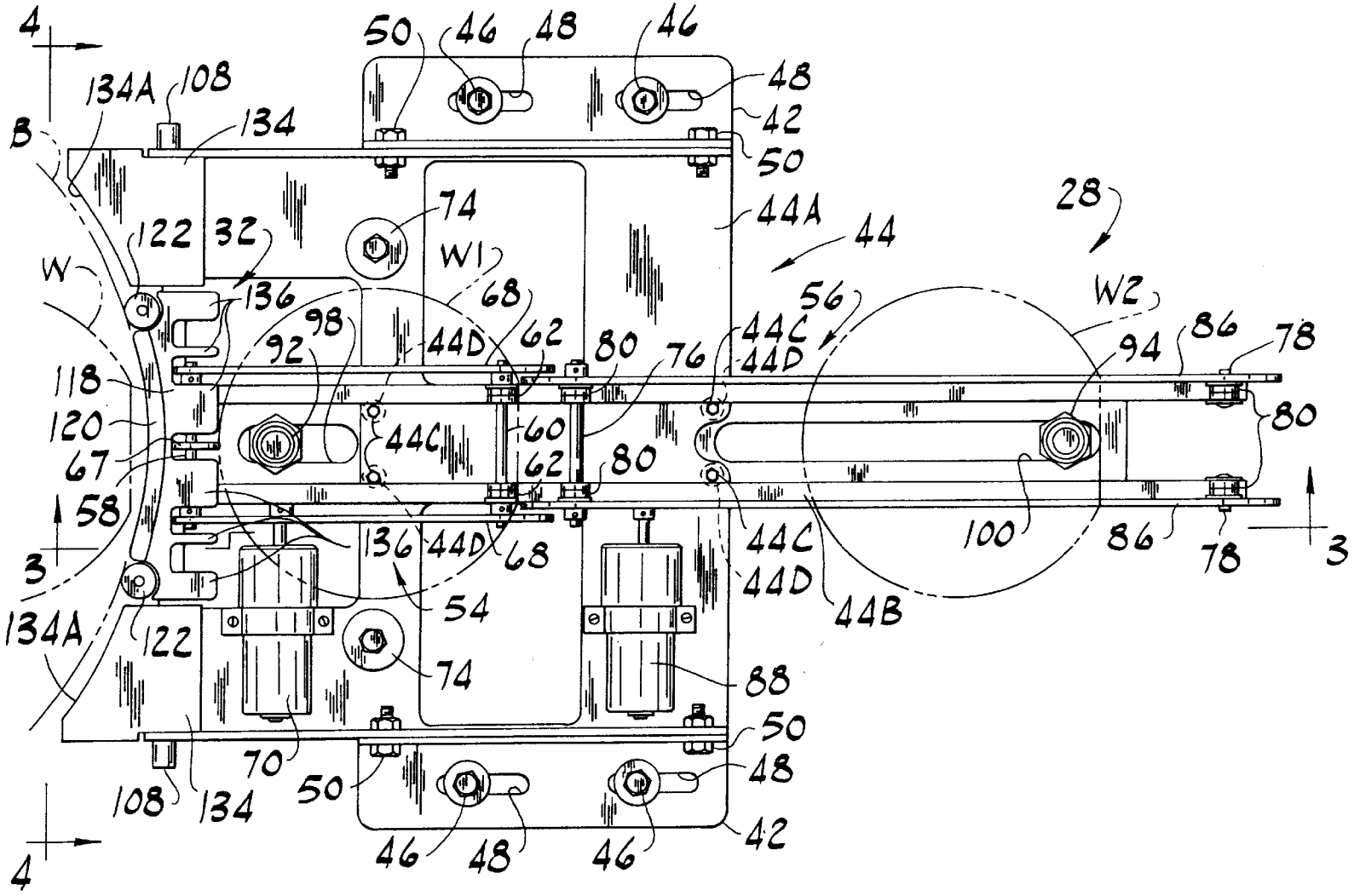
FIG. 2 is an enlarged top plan view of a bridge and offload conveyor of the wafer demount apparatus.

A wafer offload conveyor generally indicated at 28 is mounted on the frame and extends from the support 16 and polishing block B to a first inspection device 30A of the inspection and loading apparatus 12. The offload conveyor 28 is spaced from the polishing block B in the raised position defining a gap G (FIG. 2). A bridge generally indicated at 32, to be described in detail hereinafter, is located in the gap G and spans between the polishing block B and offload conveyor 28. One of the wafers W is aligned between the offload conveyor 28 and the prying tool 18 by rotation of the support 16 holding the polishing block B. Rotation is controlled by a pair of laterally spaced apart photoelectric sensors 34 (only one is shown). The sensors 34 look for a reflection of light from the polished face of the wafer W. When neither of the sensors 34 detects the reflected light, the wafer W has been properly aligned. After one wafer is removed, the polishing block B is rotated by the support 16 to bring the next wafer generally into alignment with the offload conveyor 28. Once the polishing block B is fully unloaded, the support 16 is returned to its lowered position and the block conveyor 14 removes the polishing block from the demount apparatus 10.

A second inspection device 30B of the inspection and loading apparatus 12 examines a polished face of each wafer W for back scattering of light which indicates a defect in the polished face. The inspected wafer is passed from the second inspection device 30B to a robot (not shown) which deposits the wafer in either an accept cassette 35 or a reject cassette 36 depending upon the outcome of the inspection. The inspection and loading apparatus 12, including the accept and reject cassettes 35, 36, is located on a table 38.

Figure 3:
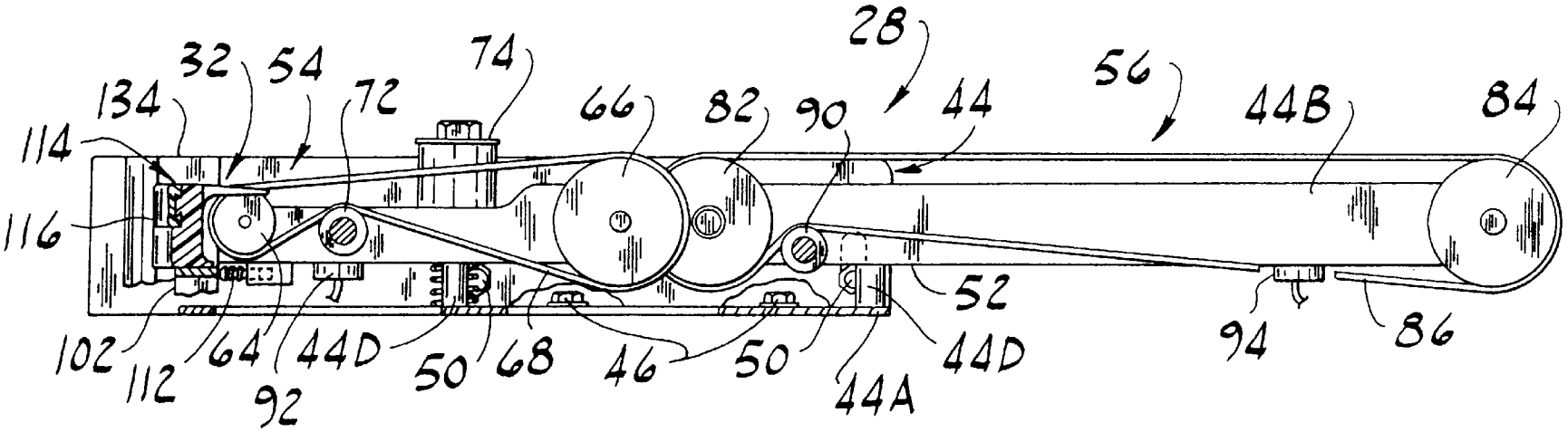
FIG. 3 is a sectional view taken in as indicated by line 3—3 of FIG. 2.

As shown in FIGS. 2 and 3, the offload conveyor 28 comprises a pair of angle brackets 42 and a frame (indicated generally at 44) mounted on the angle brackets. The angle brackets 42 are attached to the frame 24 of the demount apparatus 10 by four bolts 46 received through horizontally elongate slots 48 in the angle brackets to permit lengthwise adjustment of the position of the offload conveyor 28 between the support 16 and the inspection and loading apparatus 12. The frame 44 includes a tray 44A and a cantilever portion 44B mounted on the tray by bolts 44C. The cantilever portion 44B is spaced above the tray 44A by four tubular spacers 44D, one associated with each of the bolts 44C. Only two of the spacers 44D are illustrated in the drawings (FIG. 3). The tray 44A is attached to the angle brackets 42 on each side by two bolts 50 received in vertically elongate slots 52. The slots 52 permit height adjustment of the offload conveyor 28 and also tilting of the conveyor about a transverse horizontal axis. The foregoing adjustments permit the conveyor 28 to be positioned as needed to fit together with an existing wafer demount apparatus 10 and inspection and loading apparatus 12.

The offload conveyor 28 includes a first section and a second section (generally indicated at 54 and 56, respectively). The first section 54 comprises a first axle 58 and a second axle 60 spaced from the first axle. The first and second axles 58, 60 are mounted by bearings 62 on the cantilever portion 44B of the frame 44. The first axle 58 mounts a first pair of pulleys 64 on opposite ends, and the second axle 60 similarly mounts a second pair of pulleys 66. The first axle 58 also mounts a center wheel 67 engageable with the wafer W to pull it onto the first section 54. Only one pulley of each pair of pulleys 64, 66 is illustrated in the drawings (FIG. 3). Two continuous bands 68 extend around respective pairs of pulleys 64, 66 of the first and second axles 58, 60. A first electric motor 70 mounted on the tray 44A has a drive wheel 72 mounted on the end of its shaft and in engagement with one band 68 of the first section 54 for driving the first section. Bumpers 74 on opposite sides of the first section 54 are engageable with a wafer on the first section to force a laterally misaligned wafer back into alignment on the first section.

The second section 56 comprises a first axle 76 and a second axle 78 spaced from the first axle. The first and second axles 76, 78 are mounted by bearings 80 on the cantilever portion 44B of the frame 44. The second axles 78 are mounted for rotation on the free end of the cantilever portion 44B. The first axle 76 mounts a pair of pulleys 82 at opposite ends of the axle, and the second axles 78 each mount a pulley 84. Only one pulley of each pair is shown in the drawings (FIG. 3). Two continuous bands 86 extend around corresponding pulleys 82, 84 of the first and second axles 76, 78 to form the second offload conveyor section 56. It will be noted from FIG. 2 that the transverse spacing of the pulleys 82, 84 of the second section 56 is less than that of the first section, permitting the pulleys 82 adjacent to the first section 54 to nest partially between the pulleys 66 of the first section to allow smooth transfer of a wafer from the first section to the second section. A second electric motor 88 mounted on the tray 44A has a drive wheel 90 engaged with one of the bands 86 for operating the second section 56 independently of the first section 54. Independent operation of the conveyor sections 54, 56 permits two wafers (e.g., wafers W1 and W2 shown in FIG. 2) from the polishing block B to be staged at a single time on the offload conveyor 28. Thus, an extra wafer is provided for inspection when the demount apparatus 10 is changing over from one polishing block B to the next. In this way, continuous operation of the second inspection device 30B may be maintained.

The presence or absence of a wafer W on the first section 54 of the offload conveyor 28 is detected by a sensor 92 mounted on the cantilever portion 44B below the first section. Similarly, a sensor 94 mounted on the cantilever portion 44B of the frame 44 detects the presence or absence of a wafer on that section. Each of the sensors 92, 94 is received in a respective elongate slot (designated at 98 and 100, respectively) to permit repositioning of the sensors depending upon the size of wafer being handled.

Figure 4:
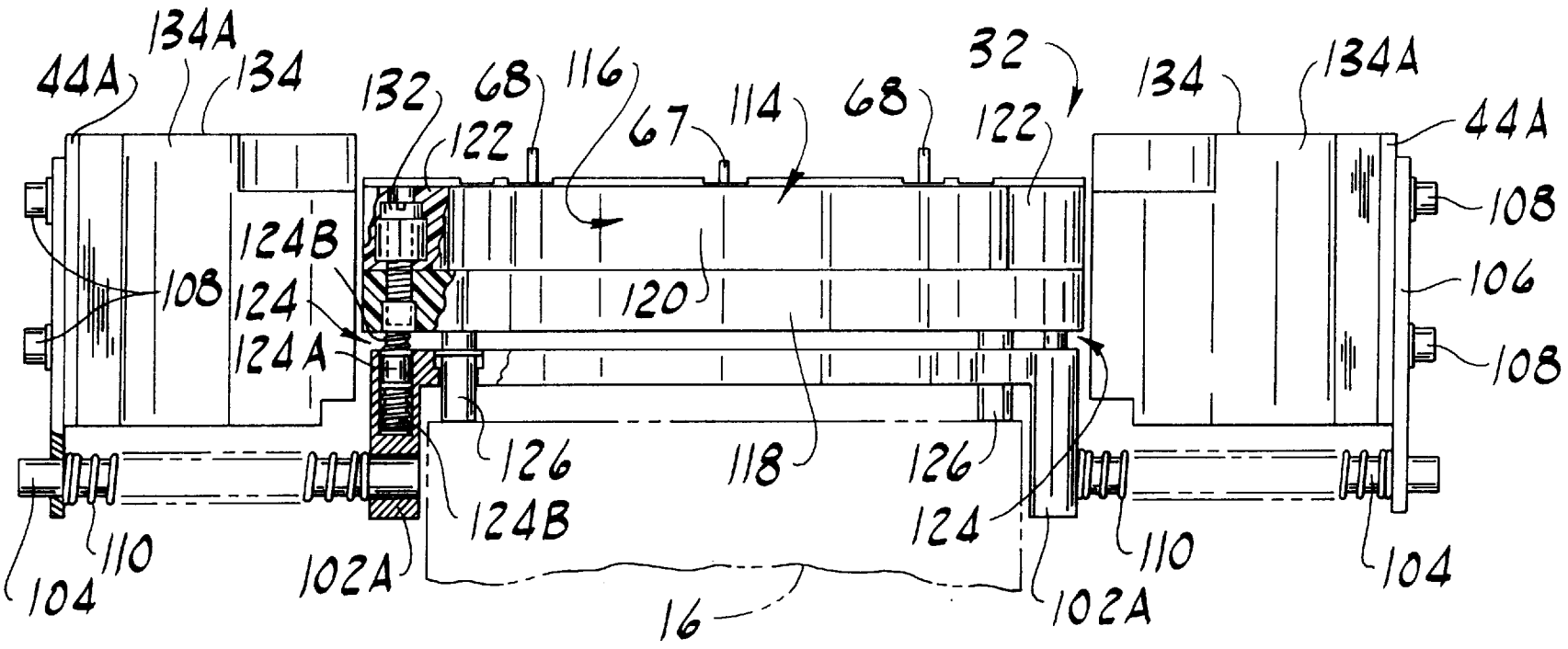
FIG. 4 is a front elevational view of the bridge and conveyor taken as indicated by line 4—4 of FIG. 2.

The gap G defined by the end of the offload conveyor 28 and the polishing block B when the support 16 is in its raised position is closed by the bridge 32 so that the wafer may travel on a substantially continuous surface from the polishing block to the offload conveyor. As shown in FIG. 4, the bridge 32 comprises a generally inverted U-shaped platform 102 made out of stainless steel. The platform 102 is pivotally mounted on two shafts 104 connected to the tray 44A of the frame 44 by respective flaps 106. The flaps 106 are attached by bolts 108 to the tray 44A and project down below the tray. The platform 102 is capable of sliding axially on the shafts 104. A coil compression spring 110 is disposed between the free end of each flap 106 and a corresponding leg 102A of the platform 102 for biasing the platform to a neutral horizontal position. A pair of springs 112, only one of which is shown (FIG. 3), are mounted on the cantilever portion 44B and engage the platform 102 to pivot it forward on the shafts 104.

The bridge 32 further comprises a deck, generally indicated at 114, disposed above the platform 102. The deck 114 includes an abutment face, generally indicated at 116, having an arcuate shape complementary to the round peripheral edge of the polishing block B. The deck 114 is made of a suitable low friction, low particulate generating polymeric material, such as Delrin® or polyurethane, and includes a permanent member 118, a wear member 120 and a pair of rollers 122 on opposite ends of the deck. The permanent member 118 is attached by a pair of spring pins, each generally indicated at 124, to the platform 102 such that the deck 114 is movable vertically with respect to the platform in a small range. Each spring pin 124 has a sleeve 124A fixedly mounted on the platform 102 and a pair of springs 124B on either side of the sleeve which bias the deck 114 to a neutral vertical position. Portions of the platform 102 and permanent member 118 are broken away to illustrate one of the spring pins 124 in FIG. 4.

A pair of vertical positioning pins 126 (broadly, "a standoff") are slidably supported in the platform 102 and are engageable with the underside of the permanent member 118 of the deck 114. A portion of the platform 102 is broken away in FIG. 4 to illustrate the positioning pin 126. The lower ends of the pins 126 depend from the platform 102 and are engageable with the support 16 which holds the polishing block B. Upon engagement with the support 16 in its raised position, the positioning pins 126 are driven upward to push against the deck 114 forcing it upward against the bias of the spring pins 124, as shown in FIG. 4. The length of the positioning pins 126 is selected so that the deck 114 is driven upwardly to a position in which a top surface of the deck is substantially coplanar with the top surface of the polishing block B.

Figure 5:
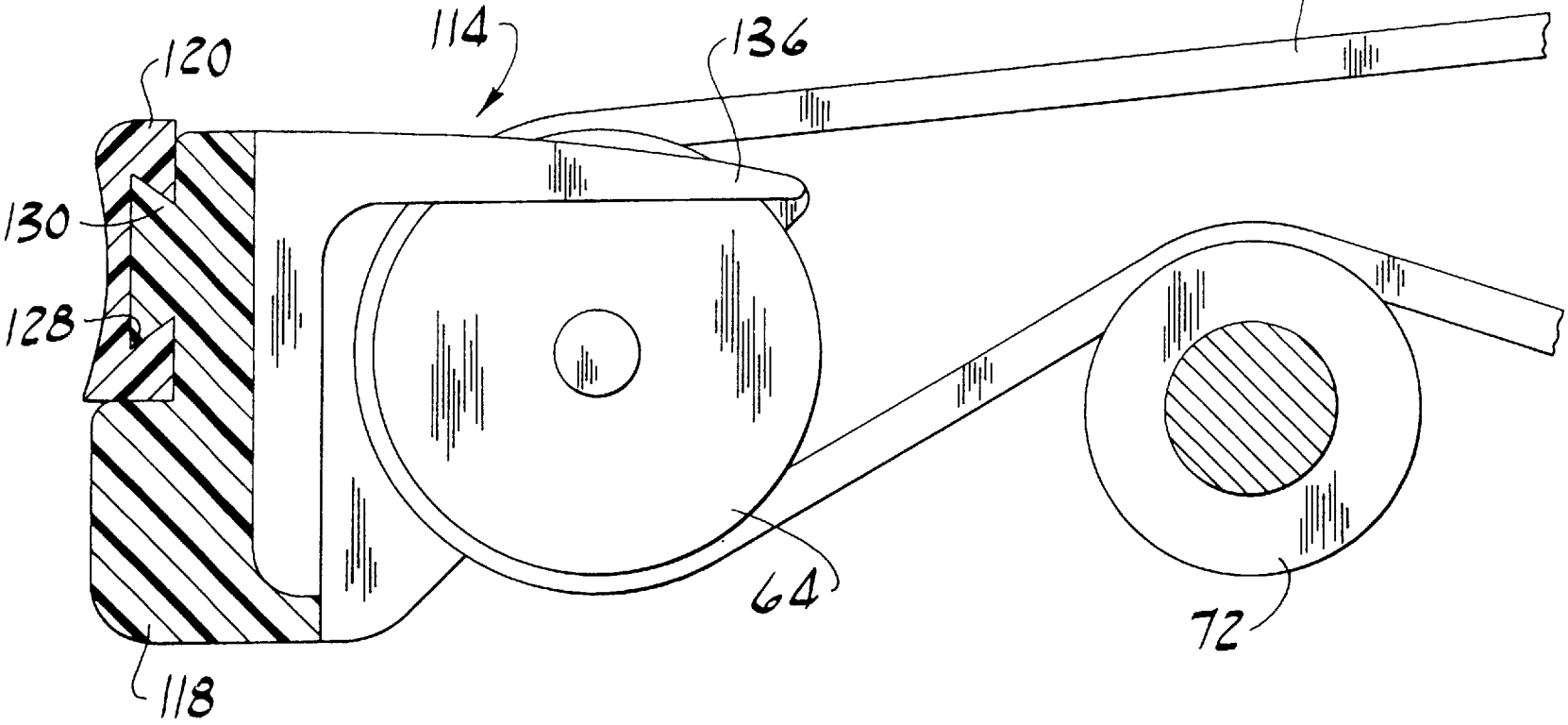
FIG. 5 is an enlarged, fragmentary portion of the sectional view of FIG. 3.

The wear member 120 is shaped and arranged to engage the polishing block B in the raised position. The portion of the wear member 120 defining the abutment face 116 of the bridge 32 is concave in vertical cross section (FIG. 5), which accepts the convex curvature of the polishing block B peripheral edge. The wear member 120 has a groove 128 which receives a tongue formation 130 on the permanent member 118 for a dovetail connection of the wear member to the permanent member. The wear member 120 can be removed and replaced by disconnecting one of the rollers from the deck 114 and sliding the wear member laterally off of the permanent member 118. However, it is to be understood that the deck 114 could be made of a single piece of material without departing from the scope of the present invention. The rollers 122 located at opposite ends of the wear member 120 are removably mounted for free rotation on the permanent member 118 by bolts 132 which are threadably received in the upper ends of the spring pins 124. The polishing block B may also engage the rollers 122 which rotate as the polishing block turns so that wear is minimized.

Two guide blocks 134 made of the same material as the bridge 32 are mounted on the tray 44A of the offload conveyor frame 44 on opposite sides of the bridge. The guide blocks 134 each have an arcuately shaped outer surface 134A generally corresponding to the shape of the abutment face 116 of the deck 114. However, the outer surfaces 134A of the guide blocks are recessed slightly behind the bridge 32 so that in ordinary circumstances the polishing block B does not engage the guide blocks 134. However, should the polishing block B become misaligned the guide blocks 134 prevent engagement with the offload conveyor 28 and guide the polishing block toward the bridge 32.

The permanent member 118 has fingers 136 which extend toward the offload conveyor 28 for transfer of the wafer W to the offload conveyor. The fingers 136 are disposed on opposite sides of each pulley 64 and have a slight downward slope (e.g., at about a 3° angle of declination). The continuous band 68 extending around each pulley 64 moves upward from between the fingers 136 to lift a wafer off of the bridge 32 and onto the offload conveyor 28. The slope of the fingers 136 and their arrangement relative to the pulleys 64 provides for a smooth transition from the bridge 32 to the offload conveyor 28.

In operation, a polishing block B having a batch of polished wafers W mounted by wax thereon are placed, wafer side up, on the block conveyor 14 which transports the polishing block to the wafer demount apparatus 10. The polishing block B is positioned on the support 16 which is activated to move from its lowered position to a raised position (shown in FIG. 1). Prior to engagement with the polishing block B, the bridge 32 is biased to pivot toward the polishing block by the springs 112. As the polishing block B is raised up by the support 16, it engages the bridge 32 and pivots it toward the offload conveyor 28 against the bias of the springs 112. The support 16 also engages the positioning pins 126 beneath the platform 102 so that the deck 114 is raised up to place its top surface on level with the top surface of the polishing block B. The positioning pins 126 may be adjusted, as by replacing the pins with pins (not shown) of a different length, to accommodate polishing blocks of different thicknesses.

The support 16 is then rotated as necessary to align a first of the wafers W with the two continuous bands 68. Rotation of the support 16 is controlled by a programmable logic controller which receives input from the photoelectric sensors 34 above the polishing block B. The photoelectric sensors 34 look for a wafer W aligned under them. The sensors 34 are positioned so that the only time neither sensors sees a wafer surface is when a wafer is properly aligned. The bridge 32 is capable of moving in case the center of the polishing block B is not aligned with the center of curvature of the arcuate abutment face 116 of the bridge. More specifically, the curvature of the abutment face 116 results in a lateral application of force to the bridge 32 when the polishing block B engages the bridge out of horizontal alignment (i.e., when the abutment face does not fully engage the polishing block). The bridge 32 is able to move laterally by sliding on the shafts 104 against the bias of the springs 110 to align itself with the polishing block B.

Once a wafer W on the polishing block B is aligned, the prying tool 18 is activated to move across the polishing block and under the wafer to pry it off of the polishing block. As the connection is released, the wafer W tends to jump slightly off of the polishing block B and prying tool 18 toward the offload conveyor 28. However, the back side of the wafer W cannot engage the edge of the polishing block B which could produce a mark on the back side of the wafer. The leading edge of the wafer cannot fall into the gap G between the offload conveyor 28 and the polishing block B, but rather engages the top surface of the bridge 32 and falls back onto the polishing block and prying tool 18. The prying tool continues its stroke to push the wafer onto the offload conveyor 28.

The leading edge of the wafer passes onto the fingers 136 and engages the bands 68 and center wheel 67 of the first section 54 of the offload conveyor 28 as they emerge from between the fingers to smoothly transition the wafer from the bridge 32 to the first section. The bumpers 74 mounted on the tray 44A on opposite sides of the first section 54 guide any misaligned wafer into a generally central position on the first section 54. The sensor 92 on the offload conveyor 28 detects the presence of the wafer and provides this information to the programmable logic controller. The first wafer removed continues from the first section 54 of the offload conveyor 28 to the second section 56. The second section carries the wafer to the first inspection device 30A where the polished face of the wafer is inspected for pre-placed laser marks indicative of a dummy wafer. If the wafer is a dummy wafer, it will be transferred through the second inspection device 30B to the reject cassette 36. However if the wafer is not a dummy wafer, it is then transferred from the second section 56 of the offload conveyor 28 to the second inspection device 30A where the polish face is inspected for faults. Thereafter, the wafer is transferred to the robot (not shown) which loads the wafer in either the accept cassette 35 or the reject cassette 36 depending upon the outcome of the inspection by the second inspection device 30A.

After the wafer is detected on the first section 54 of the offload conveyor 28, the support 16 is rotated to bring the second wafer (not shown) into alignment with the bridge 32. The mounting of the platform 102 on the shafts permits the bridge 32 to move laterally so as to remain in contact with the polishing block B in situations where the rotation of the block on the support 16 is not about the center of the block. The second wafer is demounted from the polishing block B and moved onto the first section 54 of the offload conveyor 28 in a manner similar to the first wafer. If the sensor 94 associated with the second section 56 of the offload conveyor 28 shows the first wafer has been taken from the second section, the first motor 70 operates to carry the second wafer immediately onto the second section. By the time the last wafer mounted on the polishing block B as been removed, one wafer W2 will be located on the second section 56 and another wafer W1 will be located on the first section 54 so that two wafers are staged for inspection at the first and second inspection devices 30A, 30B. The wafers W1, W2 are illustrated in phantom in FIG. 2. The first and second motors 70, 88 of the offload conveyor sections 54, 56 are able to operate independently for removing the wafer from the polishing block B and for feeding the first and second inspection devices 30A, 30B.

The support 16 is returned to its lowered position, placing the polishing block B back onto the block conveyor 14 where it is transported away for cleaning and re-use. The bridge 32 is pivoted forward by the springs 112 as the polishing block B is lowered. The pivoting of the bridge 32 places it in a position for receiving the next polishing block (not shown) without interfering with the movement of the block to its raised position. The polishing block could catch on a bridge which was fixed in position if the polishing block were somewhat out of position on the support 16. The staging of two wafers W1, W2 on the first and second sections 54, 56 of the offload conveyor 28 gives the wafer demount apparatus 10 time to bring the second polishing block into position and to raise it up without any pause in operation of the inspection and loading apparatus 12.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Wafer demount apparatus for removal of a semiconductor wafer adhered to a polishing block having top surface on which the wafer is adhered and a peripheral edge, the apparatus comprising:

a support for holding the polishing block with the wafer adhered thereto in an orientation with the wafer facing upwardly;

a wafer demount mechanism for detaching the wafer from the polishing block;

an offload conveyor positioned with respect to the wafer demount mechanism to receive the wafer after demounting by the demount mechanism to transport the wafer away from the polishing block, the offload conveyor being spaced from the support such that the nearest edge of the polishing block is spaced from the conveyor when disposed on the support to define a gap between the polishing block and conveyor;

a bridge having an abutment face of a shape complementary to that of the polishing block edge and disposed for receiving the polishing block into engagement with the bridge, the bridge being located intermediate the support and offload conveyor and bridging the gap between the polishing block when held on the support and the offload conveyor whereby the wafer is transferred from the polishing block to the conveyor without damage to the wafer when demounted from the polishing block by the wafer demount mechanism.

2. Wafer demount apparatus as set forth in claim 1 wherein the bridge is mounted for movement generally vertically with respect to the conveyor and the support for substantially co-planar alignment with a top surface of the bridge with the top surface of the polishing block.

3. Wafer demount apparatus as set forth in claim 2 wherein the support is constructed for movement between a lowered position and a raised position in which the polishing block is in engagement with the bridge, and wherein the bridge includes a standoff engageable with the support in the raised position for raising the bridge to align its top surface with the top surface of the polishing block.

4. Wafer demount apparatus as set forth in claim 3 wherein the standoff is adjustable to selectively change the height to which the bridge is raised for accommodating polishing blocks of different thicknesses.

5. Wafer demount apparatus as set forth in claim 1 wherein the bridge is mounted for movement in a generally horizontal plane for horizontal self-alignment with the polishing block when the polishing block is brought into engagement therewith.

6. Wafer demount apparatus as set forth in claim 5 wherein the bridge is slidably mounted on the conveyor for movement in a horizontal plane relative to the conveyor, and wherein the bridge comprises a spring for biasing the bridge to a selected neutral horizontal position.

7. Wafer demount apparatus as set forth in claim 1 wherein the bridge is constructed for pivoting about a generally horizontal axis and further comprises a spring for biasing the bridge to move its top surface toward the support and away from the conveyor, the support pivoting the bridge against the bias of the spring upon movement of the support to its raised position.

8. Wafer demount apparatus as set forth in claim 1 wherein the conveyor comprises a first pulley and a second pulley and a continuous band extending around the first pulley and the second pulley in a closed loop for conveying the demounted wafer on the band, and wherein the bridge comprises fingers projecting toward the conveyor on laterally opposite sides of the band, the band extending generally upwardly between the fingers for lifting the demounted wafer off of the bridge and onto the conveyor.

9. Wafer demount apparatus as set forth in claim 8 wherein the fingers are curved downwardly toward their distal ends.

10. Wafer demount apparatus as set forth in claim 1 wherein the bridge comprises a removable wear member at least partially defining the abutment face of the bridge, the wear member being adapted for removal from the remainder of the bridge.

11. Wafer demount apparatus as set forth in claim 10 wherein the wear member is formed for a dovetail connection to the bridge.

12. Wafer demount apparatus as set forth in claim 10 wherein the bridge further comprises rollers engageable with the polishing block for reducing wear upon engagement of the polishing block with the bridge.

13. Wafer demount apparatus as set forth in claim 1 wherein the conveyor comprises a first conveyor section and a second conveyor section, a first motor connected to the first conveyor section and a second motor connected to the second conveyor section, the first and second motors being independently operable.

14. Wafer demount apparatus as set forth in claim 13 wherein the conveyor further comprises a frame supporting the first and second conveyor sections and first and second motors, and a base, the frame being adjustably mounted on the base for selective positioning of the frame relative to the base.

15. Wafer demount apparatus for removal of a semiconductor wafer adhered to a polishing block having top surface on which the wafer is adhered and a peripheral edge, the apparatus comprising:

a support for holding the polishing block with the wafer adhered thereto in an orientation with the wafer facing upwardly;

a wafer demount mechanism for detaching the wafer from the polishing block;

an offload conveyor positioned with respect to the wafer demount mechanism to receive the wafer after demounting by the demount mechanism to transport the wafer away from the polishing block, the offload conveyor being spaced from the support such that the nearest edge of the polishing block is spaced from the conveyor when disposed on the support to define a gap between the polishing block and conveyor;

a bridge having an abutment face disposed for receiving the polishing block into engagement with the bridge, the bridge being mounted for movement upon engagement with the polishing block for alignment of the bridge with the polishing block, the bridge being located intermediate the support and offload conveyor and bridging the gap between the polishing block when held on the support and the offload conveyor whereby the wafer is transferred from the polishing block to the conveyor without damage to the wafer demounted from the polishing block by the wafer demount mechanism.

16. Wafer demount apparatus as set forth in claim 15 wherein the support is constructed for movement between a lowered position and a raised position in which the polishing block is in engagement with the bridge, and wherein the bridge includes a standoff engageable with the support in the raised position for raising the bridge to align its top surface with the top surface of the polishing block.

17. Wafer demount apparatus as set forth in claim 15 wherein the bridge is slidably mounted on the conveyor for movement in a horizontal plane relative to the conveyor, and wherein the bridge comprises a spring for biasing the bridge to a selected neutral horizontal position.

18. Wafer demount apparatus as set forth in claim 15 wherein the bridge is constructed for pivoting about a generally horizontal axis and further comprises a spring for biasing the bridge to move its top surface toward the support and away from the conveyor, the polishing block pivoting the bridge against the bias of the spring upon movement of the support to its raised position.

19. Wafer demount apparatus as set forth in claim 15 wherein the conveyor comprises a first pulley and a second pulley and a continuous band extending around the first pulley and the second pulley in a closed loop for conveying the demounted wafer on the band, and wherein the bridge comprises fingers projecting toward the conveyor on laterally opposite sides of the band, the band extending generally upwardly between the fingers for lifting the demounted wafer off of the bridge and onto the conveyor.

20. Wafer demount apparatus as set forth in claim 15 wherein the bridge comprises a removable wear member at least partially defining the abutment face of the bridge, the wear member being adapted for removal from the remainder of the bridge.

* * * * *